United States Patent [19]

Kist

[11] Patent Number: 4,957,283

[45] Date of Patent: Sep. 18, 1990

[54] VACUUM SYSTEM FOR FEEDING SHEETS

[75] Inventor: William J. Kist, Barrington, Ill.

[73] Assignee: Combined Fluid Products Co., Lake Zurich, Ill.

[21] Appl. No.: 255,550

[22] Filed: Oct. 7, 1988

[51] Int. Cl.[5] ..... B65H 3/08; F16D 31/02; F04B 49/08

[52] U.S. Cl. ..... 271/90; 271/194; 271/96; 417/286; 60/422

[58] Field of Search ..... 271/90, 194, 202, 96; 60/403, 405, 420, 422; 417/286, 287, 442

[56] References Cited

U.S. PATENT DOCUMENTS

| | | | |
|---|---|---|---|
| 3,716,308 | 2/1973 | Kobald | 417/286 |
| 3,841,095 | 10/1974 | Baker | 60/422 |
| 3,999,795 | 12/1976 | Barker | 271/90 |
| 4,024,710 | 5/1977 | Zelle | 60/422 |
| 4,070,857 | 1/1978 | Wible | 60/422 |
| 4,513,957 | 4/1985 | Schaefer, Jr. | 271/90 |
| 4,640,503 | 2/1987 | Naumann | 271/90 |

*Primary Examiner*—Joseph J. Rolla
*Assistant Examiner*—Steven Reiss
*Attorney, Agent, or Firm*—Leydig, Voit & Mayer

[57] ABSTRACT

A pneumatic system which in the preferred embodiment includes a pump having a primary suction port and a secondary suction port, with the pump being operable for generating vacuum pressures at both such ports. A first vacuum operated system is coupled to the primary suction port and a second vacuum operated system is coupled to the secondary suction port, and a predetermined, preferably selectively adjustable, orifice is established between the first and second vacuum operated systems for enabling vacuum airflow generated at the first suction port to augment the airflow through the second vacuum operated system. In an alternative embodiment, separate standard vacuum pumps are coupled to the first and second vacuum operated systems.

16 Claims, 2 Drawing Sheets

FIG. 3
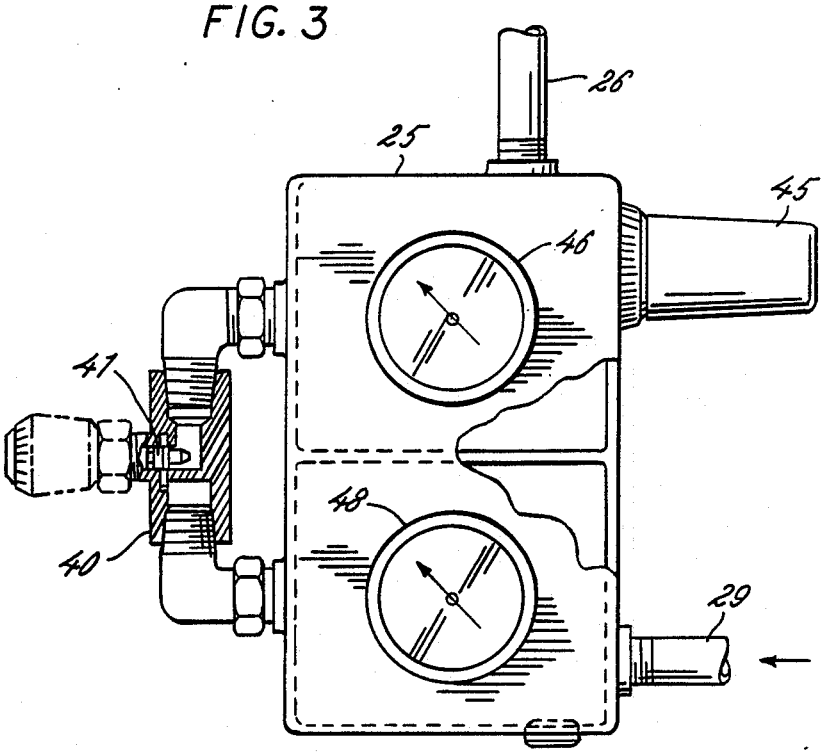
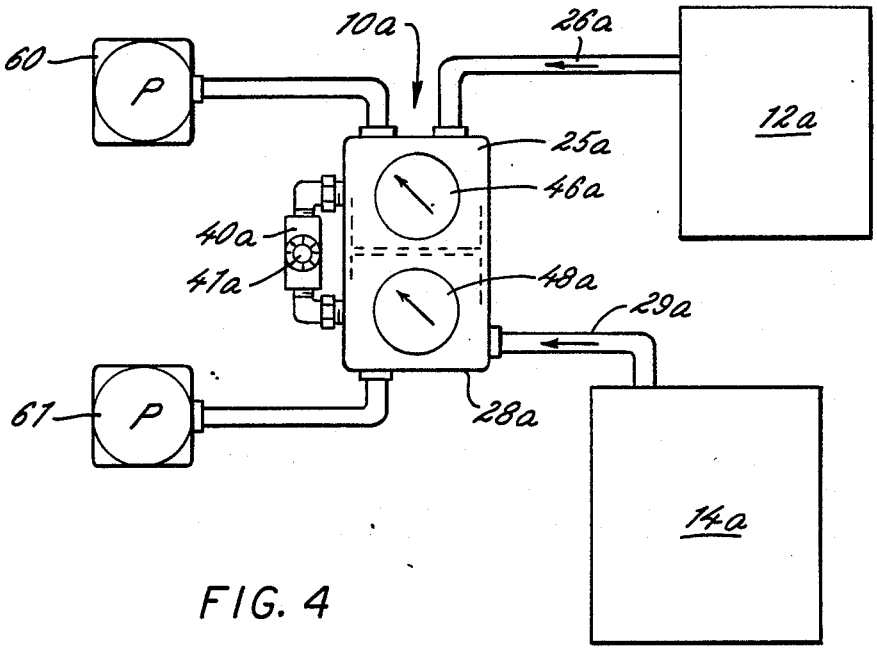
FIG. 4

VACUUM SYSTEM FOR FEEDING SHEETS

DESCRIPTION OF THE INVENTION

The present invention relates generally to pneumatic systems, and more particularly, to pneumatic systems which include a plurality of related or unrelated vacuum operated systems.

Rotary vane type compressor/vacuum pumps have been developed which include a single rotor unit that operates as both a compressor and vacuum pump. Such compressor/vacuum pumps are designed with both primary and secondary suction ports. The secondary suction port is located between the primary suction port and the discharge port and is uncovered upon completion of an initial vacuum stroke, but before the compression stroke, for enabling a second induction or charge of air to be drawn into the pump chamber. The second charge of air increases the mass flow rate through the pump, thereby providing an effective compressor output function without causing the loss of vacuum capabilities. Moreover, the primary and secondary suction ports both may be coupled to respective vacuum operated systems.

Because the proportionate air flows through the primary and secondary suction ports is fixed, such compressor/vacuum pumps often do not lend themselves to applicability to a plurality of vacuum operated systems which require different proportionate airflows. For example, if the compressor/vacuum pump is designed such that 90% of the airflow is drawn through the primary suction port and 10% is drawn through the secondary suction port, the vacuum communicated to the primary vacuum operated system may be greatly in excess of that required, while the vacuum communicated to the secondary vacuum operated system may be less than required. When such compressor/vacuum pumps are used to operate a plurality of vacuum operated systems, it has been the practice to select a pump having primary and secondary suction capacities in excess of the respective primary and secondary vacuum operated system requirements, and then to draw atmospheric air into each system, such as through vacuum relief valves or the like, to control vacuum pressure, which results in waste and inefficiency in the operation of the pump.

Even when separate vacuum pumps are used for separate vacuum operated systems, it is often difficult to match the vacuum drawing capability of the pump with the requirement of the respective system. It is customary to utilize a pump for each system that has a capacity in excess of the vacuum requirement and to draw in atmospheric air in order to achieve the required vacuum pressure, which again results in an operating inefficiency.

It is an object of the present invention to provide a pneumatic system having a plurality of vacuum operated systems that are adapted for more efficient operation from a plurality of vacuum generators.

Another object is to provide a pneumatic system as characterized above which includes a single compressor/vacuum pump having primary and secondary suction capacities.

A further object is to provide a pneumatic system of the above kind in which means are provided for selectively establishing the optimum vacuum pressures communicated to the respective vacuum operated systems.

Still another object is to provide a pneumatic system as characterized above in which selectively operable means are provided for varying vacuum pressures communicated to the respective vacuum operated systems. Other objects and advantages of the invention will become apparent upon reading the following detailed description and upon reference to the drawings, in which.

Figure 1:
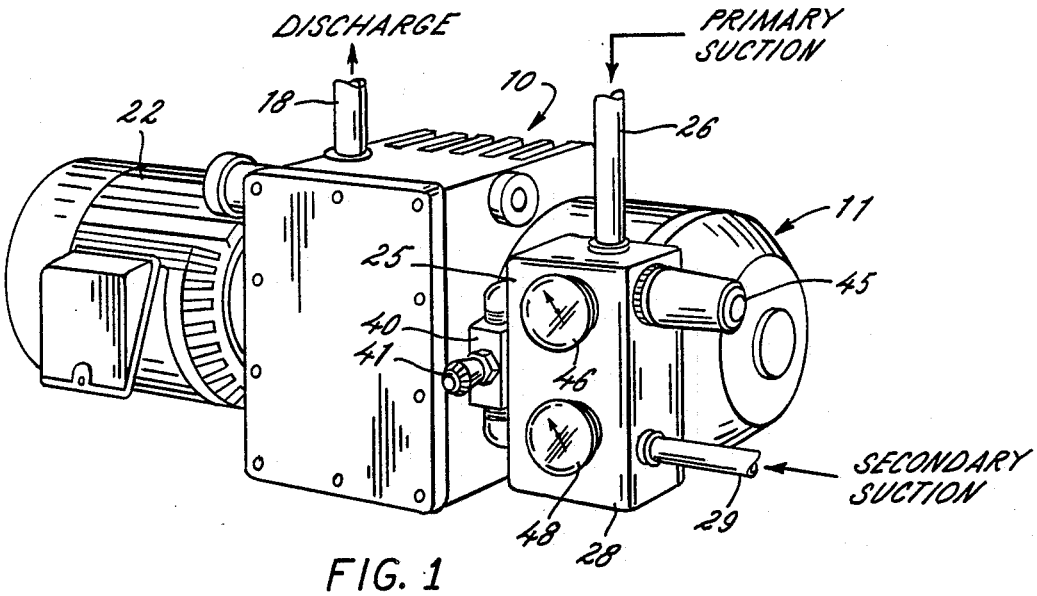
FIG. 1 is a perspective of an illustrative pneumatic system embodying the present invention.
Figure 2:
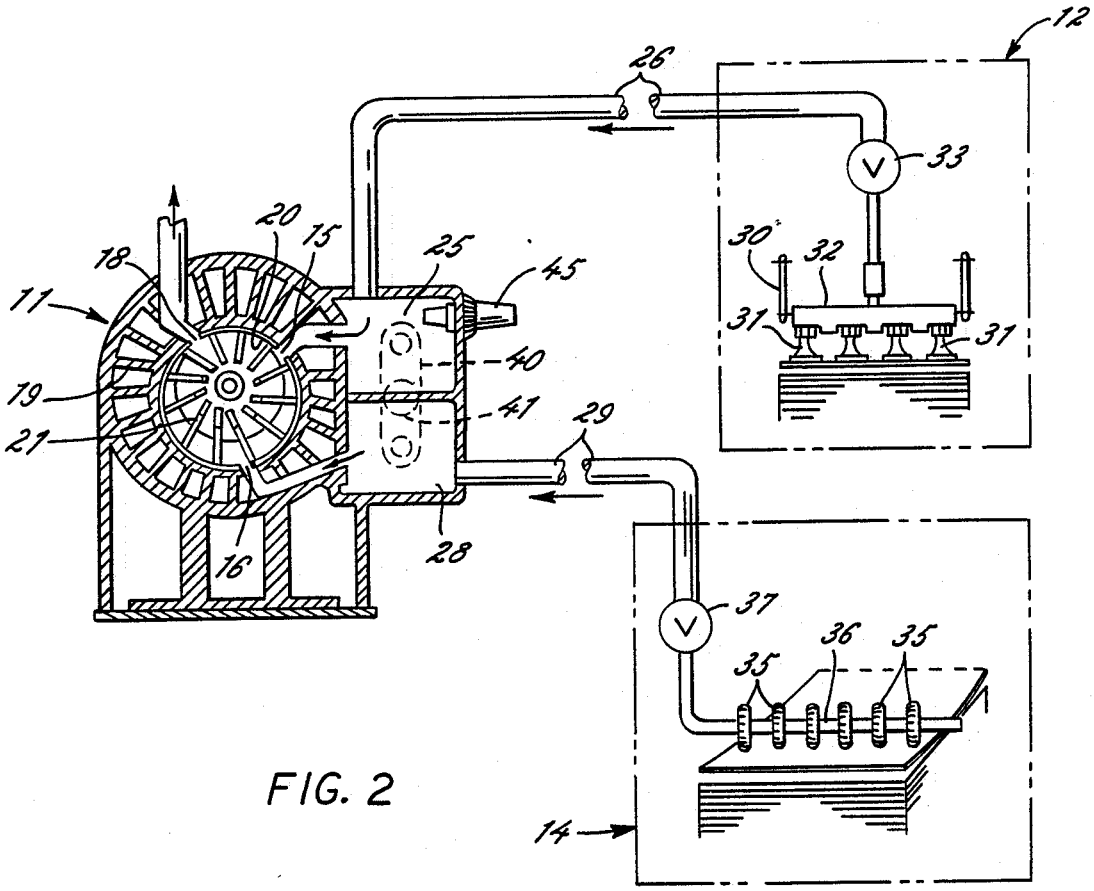
FIG. 2 is a partially diagrammatic section of the illustrated pneumatic system.

FIG. 3 s an enlarged fragmentary section showing orifice defining means between primary and secondary vacuum operated systems; and FIG. 4 is a partially diagrammatic illustration of an alternative embodiment of pneumatic systems. While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Referring now more particularly to the drawings, there is shown an illustrative pneumatic system 10 embodying the present invention, which comprises a compressor/vacuum pump 11, a first or primary vacuum operated pneumatic system 12, and a second or secondary vacuum operated pneumatic system 14. The compressor/vacuum pump 11 may be of a conventional type, having a primary suction port 15, a secondary suction port 16, and a discharge port 18. The illustrated pump 11 has an outer fin-configured body 19 defining a pump chamber 20 which contains a vane type rotor 21 driven by a motor 22. During operation of the pump, air is drawn into the primary suction port 15 during an initial vacuum stroke, creating vacuum pressure at the primary suction port 15, and thereafter, a second induction or charge of air is drawn into the pump chamber 20 through the secondary suction port 16, which provides an additional air mass for the pressure flow through the discharge port 18, as well as creating vacuum pressure at the secondary suction port 16. As is known in the art, compressor/vacuum pumps of such type are designed with a fixed relationship in the proportionate suction capacities at the primary and secondary suction ports 15, 16.

The primary suction port 15 in this instance communicates with a primary vacuum plenum 25 which in turn is coupled to the first vacuum operated system 12 through a conduit 26. The secondary suction port 16 communicates through a secondary vacuum plenum 28, in this case disposed in immediately adjacent relation to the primary vacuum plenum 25, and in turn is coupled to the secondary vacuum operated system 14 through a conduit 29.

The primary vacuum operated system 12 in the illustrated embodiment is a conventional vacuum pick up device 30 for a sheet feeder which, for example, may be located at the upstream end of a printing press. The vacuum pick up device 30 includes a plurality of suction heads 31 supported in depending relation from a manifold 32 which in turn is connected to the conduit 26. Vacuum pressure generated at the primary suction port 15 may be communicated through the plenum 25, conduit 26, and manifold 32 to draw an airflow through the suction heads 31 for creating a predetermined vacuum pressure in the suction heads for enabling pick up of successive sheets by the sheet feeder. An appropriate control valve 33, such as a slide valve or solenoid operated valve, is provided in the conduit 26 for controlling communication of the suction pressure to the vacuum pick up device 30 in timed relation to the desired operation of the pick up device.

The secondary vacuum operated system 14 in this instance is a conventional sheet slow down device which may be located at the delivery end of a printing press. The slow down device comprises a plurality of vacuum wheels 35 supported on a common manifold 36 which in turn is coupled to the conduit 29. Vacuum pressure generated at the secondary suction port 16 may be communicated through the plenum 28, conduit 29, and manifold pipe 36 to draw an airflow through the vacuum wheels 35 for creating a determined vacuum pressure at the vacuum wheels, which may be utilized for decelerating sheets following printing. A throttling valve 37 in this case is provided in the conduit 29 for the purpose of permitting relatively precise adjustment of the vacuum pressure at the secondary operated vacuum system.

Since the proportionate airflow capacities through the primary and secondary suction ports 15, 16 is fixed, heretofore, if the primary and secondary vacuum capacities of a compressor/vacuum pump were to be utilized to operate respective pneumatic systems, the pump 11 had to be selected such as its primary and secondary vacuum capacities conformed to or exceeded the requirements of the respective vacuum operated systems 12, 14, with atmospheric air being drawn into each system through vacuum relief valves or the like to achieve the required vacuum pressure. Even if the primary suction capacity of the pump greatly exceeded the requirement for the primary vacuum operated system, if the secondary suction capacity was insufficient for the requirements of the secondary vacuum operated system, heretofore the compressor/vacuum pump either could not be utilized for such systems, or an auxiliary vacuum pump would be required for the secondary vacuum operated system.

In accordance with the present invention, means are provided for connecting the primary and secondary suction ports so that excess capacity of the primary suction may be utilized to augment the airflow and vacuum pressures required in the secondary vacuum operated system. To this end, in the illustrated embodiment, a conduit or duct 40 containing an orifice defining means 41 is connected between the primary and secondary vacuum plenums 25, 28 so as to permit a portion of the excess capacity of the primary suction to be communicated to the secondary vacuum operated system 14 to increase the airflow and vacuum pressure at the secondary vacuum operated system. The illustrated orifice defining means 41 is a selectively adjustable needle valve, such as the type commercially sold by Deltrol Fluid Products, Bellwood, Ill., which may be set to establish the desired orifice size for creating optimum airflow and vacuum pressures in the secondary system 14. In the event excess vacuum capacity still exists in the primary vacuum system 12, a vacuum relief valve 45 in the primary vacuum plenum 25 may be operable to draw in atmospheric air to achieve the required vacuum pressure. To assist in determining the proper adjustment of vacuum pressures in the primary and secondary vacuum operated systems 12, 14, pressure gauges 46, 48 are provided in the respective primary and secondary vacuum plenums 25, 28. Hence, it will be seen that even though the compressor/vacuum pump 11 may be designed with fixed proportionate vacuum capacities at the primary and secondary vacuum ports 15, 16, such as 90% and 10% respectively, through selective adjustment of the orifice size in the valve 41, the proportionate vacuum levels at the primary and secondary vacuum operated system 12, 14, may be varied for optimum utilization.

It has been determined that the size of the orifice communicating between the primary and secondary systems can be critical. For example, a ¼" diameter orifice requires an airflow of 12.8 cubic feet per minute for maintaining a vacuum pressure of 18" mercury, while a 5/16th inch orifice requires an airflow of 20 cfm for maintaining such vacuum. If the orifice is made too large, the operation of both the primary and secondary vacuum systems can be rendered ineffective. It will be understood that alternatively a relatively small diameter, orifice-member may be mounted at any convenient point where the primary and secondary vacuum plenums or conduits are interconnected for defining a fixed orifice, and the valve 41 may be used for providing additional adjustments in the airflow between the primary and secondary vacuum systems.

Referring now to FIG. 4, there is shown an alternative embodiment of a pneumatic system 10*a* according to the present invention wherein items similar to those described above have been given similar reference numerals with the distinguishing "a" added. In the pneumatic system 10*a*, primary and secondary vacuum operated systems 12*a*, 14*a*, are operated from individual vacuum pumps 60, 61 which each communicate with a respective primary and secondary vacuum plenum 25*a*, 28*a* and conduit 26*a*, 29*a*. In order that excess capacity of the primary vacuum pump 60 may be utilized to augment the vacuum pressure and airflow at the secondary vacuum operated system 14*a*, the primary and secondary vacuum plenums 25*a*, 28*a* are connected through an orifice defining means 41*a* in a manner similar to that described above. As a result, even though the secondary vacuum pump 61 may have insufficient capacity for operating the secondary vacuum operated system 14*a* alone, through selected establishment of the orifice between the primary and secondary systems, excess capacity of the primary vacuum pump 60, which would otherwise be wasted, can be utilized to augment the secondary vacuum operated system, resulting in more efficiently overall operation.

From the foregoing, it can be seen that a pneumatic system having a plurality of vacuum operated systems is provided in which a plurality of vacuum generators may be adapted for more optimum and efficient utilization. The pneumatic system may include a single compressor/vacuum pump or individual vacuum pumps for each vacuum operated system, with selectively adjustable orifice means being adapted to permit optimum distribution of vacuum pressures to the respective vacuum operated systems. It will be understood that as used herein vacuum operated system is intended to include any pneumatic system which is operated from or utilizes vacuum pressures or airflows resulting from vacuum pressures.

I claim as my invention:

1. A pneumatic system comprising first means for generating a vacuum pressure, first vacuum operated means, first means coupling said first vacuum generating means to said first vacuum operated means for causing an airflow to be drawn from said first vacuum operated means to said first vacuum generating means for creating a vacuum pressure at said first vacuum operated means, second means for generating a vacuum pressure, second vacuum operated means, second means coupling said second vacuum generating means to said second vacuum operated means for causing an airflow to be drawn from said second vacuum operated means to said second vacuum generating means for creating a vacuum pressure at said second vacuum operated means, said first and second vacuum generating means being a single compressor/vacuum pump having primary and secondary suction ports, said first coupling means being connected to said primary suction port and said second coupling means being connected to said secondary suction port, and orifice means connecting said first and second coupling means for enabling said first vacuum generating means to augment the airflow that is being drawn from said second vacuum operated means and increase the vacuum pressure at said second vacuum operated means.

2. The pneumatic system of claim 1 in which said orifice means is adjustable.

3. The pneumatic system of claim 2 in which said adjustable orifice means is a selectively adjustable valve.

4. The pneumatic system of claim 1 in which said pump is operable for producing a higher vacuum pressure at said primary suction port than at said secondary suction port, and said orifice means is operable for changing the proportionate relationship in vacuum operated means as compared to the airflows at vacuum operated means as compared to the airflows at said primary and secondary vacuum ports.

5. The pneumatic system of claim 4 in which said orifice means is adjustable.

6. The pneumatic system of claim 1 in which said pump has an outlet port through which compressed air is discharged.

7. The pneumatic system of claim 1 in which said pump is operable for producing a higher vacuum pressure at said primary suction port than at said secondary suction port, and said orifice means is operable for changing the proportionate relationship in vacuum generated airflow at said first and second vacuum operated means as compared to the airflow at said primary and secondary suction ports.

8. A pneumatic system comprising a pump having a primary suction port, a secondary suction port, and a discharge port, said pump being operable for generating vacuum pressures at said primary and secondary suction ports, first vacuum operated means, a primary vacuum plenum in communication with said primary suction port, first coupling means including a conduit connecting said primary vacuum plenum with said first vacuum operated means, secondary vacuum operated means, a secondary vacuum plenum communicating with said secondary suction port, second coupling means including a conduit connecting said secondary vacuum plenum to said second vacuum operated means, and orifice means connecting said plenums.

9. The pneumatic system of claim 8 including a duct connected between said primary and secondary vacuum plenums, said orifice means being located in said duct.

10. The pneumatic system of claim 9 in which said orifice means is a selectively adjustable valve.

11. The pneumatic system of claim 9 including first vacuum gauge means for indicating the vacuum communicated to said first vacuum operated means, and second vacuum gauge means for indicating the vacuum communicated to said second vacuum operated means.

12. A vacuum operated pneumatic system comprising first means for generating a vacuum pressure, first vacuum operated means, first means coupling said first vacuum generating means to said first vacuum operated means for causing an airflow to be drawn from said first vacuum operated means to said first vacuum generating means for creating a vacuum pressure at said first vacuum operated means, second means for generating a vacuum pressure, second vacuum operated means, second means coupling said second vacuum generating means to said second vacuum operated means for causing an airflow to be drawn from said second vacuum operated means to said second vacuum generating means for creating a vacuum pressure at said second vacuum operated means, said first vacuum generating means being operable for generating a greater vacuum pressure and air flow than said second vacuum generating means and, orifice means in the form of a non-pressure responsive orifice defining member connecting said first and second coupling means for enabling said first vacuum generating means to augment the airflow that is being drawn form said second vacuum operated means and thereby changer the proportionate relationship in vacuum generated air flows at said first and second vacuum operated means as compared to the air flows at said first and second vacuum generating means.

13. The pneumatic system of claim 12 in which said orifice member that defines a fixed relatively small sized orifice.

14. The pneumatic system of claim 13 in which said orifice means defines an orifice of between about ¼and 5/16 inch in diameter.

15. A vacuum operated pneumatic system comprising first means for generating a vacuum pressure, first vacuum operated means, first means coupling said first vacuum generating means to said first vacuum operated means for causing an airflow to be drawn form said first vacuum operated means to said first vacuum generating means for creating a vacuum pressure at said first vacuum operated means, second means for generating a vacuum pressure, second vacuum operated means, second means coupling said second vacuum generating means to said second vacuum operated means for causing an airflow to be drawn from said second vacuum operated means to said second vacuum generating means for creating a vacuum pressure at said second vacuum operated means, said first vacuum generating means being operable for generating a greater vacuum pressure and air flow than said second vacuum generating means, and, orifice means connecting said first and second coupling means for enabling said first vacuum generating means to augment the airflow that is being drawn form said second vacuum operated means and thereby change the proportionate relationship in vacuum operated means as compared to the air flows at said first and second vacuum generating means, said orifice means including an orifice member that defines a fixed relatively small sized orifice and a non-pressure responsive selectively adjustable valve.

16. A pneumatic system for a printing press comprising a pump having a primary suction port, a secondary suction port, and a discharge port, said pump being operable for generating vacuum pressures at said primary and secondary suction ports, first vacuum operated means including a vacuum operated sheet pick up device at an upstream end of the printing press, first means coupling said primary suction port to said first vacuum operated means, secondary vacuum operated means including a vacuum operated sheet slow down device at a delivery end of the printing press, second means coupling said secondary suction port to said second vacuum operated means, and orifice means connecting said first and second coupling means.

* * * * *

UNITED STATES PATENT AND TRADEMARK OFFICE

CERTIFICATE OF CORRECTION

PATENT NO. : 4,957,283

DATED : September 18, 1990

INVENTOR(S) : William J. Kist

It is certified that error appears in the above-identified patent and that said Letters Patent is hereby corrected as shown below:

Col. 2, line 5, begin a new paragraph with "Other".

Col. 2, line 13, "s" should be -- is --.

Col. 2, line 17, begin a new paragraph with "While".

Col. 5, line 37, after "vacuum" insert -- generated airflows at said first and second vacuum" --.

Signed and Sealed this

Twenty-eighth Day of April, 1992

*Attest:*

HARRY F. MANBECK, JR.

*Attesting Officer*

*Commissioner of Patents and Trademarks*